US005239835A

United States Patent [19]

Kitaguchi et al.

[11] Patent Number: 5,239,835

[45] Date of Patent: Aug. 31, 1993

[54] REFRIGERATION SYSTEM CONSISTING OF A PLURALITY OF REFRIGERATING CYCLES

[75] Inventors: Masaru Kitaguchi, Ibaragi; Shigeru Sakashita, Tokyo, both of Japan

[73] Assignees: Asahi Breweries, Ltd.; Mayekawa Mfg. Co., Ltd., both of Japan

[21] Appl. No.: 871,548

[22] Filed: Apr. 21, 1992

[30] Foreign Application Priority Data

Apr. 23, 1991 [JP] Japan ..... 3-92385
Apr. 23, 1991 [JP] Japan ..... 3-92386
Apr. 23, 1991 [JP] Japan ..... 3-92387

[51] Int. Cl.[5] ..... F25B 1/10

[52] U.S. Cl. ..... 62/217; 62/510; 62/DIG. 2

[58] Field of Search ..... 62/175, 510, 217, DIG. 2, 62/509; 236/1 EA

[56] References Cited

U.S. PATENT DOCUMENTS 2,453,095 11/1948 McGrath ..... 62/217 X
4,193,270 3/1980 Scott ..... 62/175

FOREIGN PATENT DOCUMENTS 0076763 10/1982 European Pat. Off. .
0179225 8/1985 European Pat. Off. .
2402844 9/1977 France .
0877261 10/1981 U.S.S.R. .

*Primary Examiner*—William E. Wayner
*Attorney, Agent, or Firm*—Townsend, Snider & Banta

[57] ABSTRACT

The present inventions are intended to improve heat efficiency of a refrigeration system having plural refrigerating cycles of different evaporating or condensing temperatures typically used in breweries. Each of main lines of different evaporating temperatures are connected with each of suction lines to a compressor respectively, to enable the system to save energy and to establish a back-up system of compressors. A different condensing temperature system having a common refrigerant source is provided with refrigerant transferring means to transfer refrigerant from an refrigerant excess cycle to an refrigerant insufficiency cycle. The refrigerating cycles are arranged in parallel and the evaporators are connected to form a liquid path, through which a liquid stream flows in series to be chilled in the evaporators, as well as to form a refrigerant path for a refigerant stream of each rerigerating cycle, individually, and further are arranged in order from a high evaporating temperature of refrigerant to low one along the liquid path from the upstream to the downstream.

7 Claims, 7 Drawing Sheets

REFRIGERATION SYSTEM CONSISTING OF A PLURALITY OF REFRIGERATING CYCLES

BACKGROUND OF THE INVENTION

1. Field of the Invention

The present invention disclosed herein broadly relates to improvement of heat efficiency of a refrigeration system consisting of a plurality of refrigerating cycles, and more particularly relates to;

firstly improvement of heat efficiency of a refrigeration system consisting of a plurality of refrigerating cycles connected respectively to a plurality of refrigerant vapor lines, through each of which a refrigerant stream of a different evaporating temperature flows, respectively;

secondly improvement of heat efficiency of a refrigeration system consisting of a plurality of refrigerating cycles, each of which has a different condensing temperature or a different condensing pressure of refrigerant, and;

thirdly improvement of heat efficiency of chilling facilities for chilling liquid, into which a refrigeration system consisting of a plurality of refrigerating cycles is incorporated.

Further, the present invention includes improved refrigeration systems and improved chilling facilities used for chilling various kinds of fluid, especially for chilling malt cooling water, which is ciruculately used as coolant in a brewery for cooling hot malt juice before sent to a fermenting process.

2. Description of the Prior Art

Various kinds of liquids or gases are required to cbe chilled for finishing or further treating in food processing industries such as breweries, and they are generally chilled by individual refrigerating cycles provided and operated independently and separately each other, because ideas on integration of such individual refrigerating cycles to great extent have not been necessarily established yet.

A number of improved systems of heat utilization have been proposed, but they are only for the purpose of improving heat efficiency in an individual refrigerating cycle.

In food processing plants such as breweries, however, many kinds of refrigeration loads actually exist, and refrigerating temperatures are also classified to many temperature levels. Furthermore, each refrigeration load varies timewise and daywise in terms of magnitude and its ratio to the entire load.

Thus, an overall improvement of heat utilization should be attempted, considering a combination of a plurality of refrigerating cycles having individual refrigeration loads.

The following two systems have been known as the refrigeration systems to handle refrigeration loads of multiple temperatures and of great varieties as described above.

A refrigeration system has, as shown in FIG. 2, compressors 11, condensers 12, reservoirs 13, expansion valves 14 and evaporators 15. Evaporators 15 and compressors 11 are connected each other through a common refrigerant vapor line 16 for integration as the system.

The evaporating pressures in the respective evaporators are controlled by adjusting valve opening of an evaporating pressure regulator (EPR) 17, or by adjusting the flow rate of cooling medium such as cooling water, refrigerant etc. to be supplied to each condenser (heat exchanger) 12, while all of the compressors such refrigerant gas at the pressure corresponding to the lowest evaporating temperature (in this case, −10 deg. C. (degrees Centigrade)) among the evaporating temperatures of the evaporators.

Another refrigeration system is comprised of a group of separate refrigerating cycles individually provided with necessary equipment such as a compressor, a condenser, a reservoir, etc. each of which refrigerating cycles is fixedly assigned to each particular refrigeration load.

A great deal of power is needed in the refrigeration system shown in FIG. 2, since all of the compressors have to suck refrigerant gas at the lowest evaporating temperature (−10 deg. C.). Additionally, a specific compressor out of compressors 11 may not be always selectively assigned to a specific load, and the optimization for sharing of loads in compressors is not feasible, resulting in higher power consumption at all.

In the refrigeration system shown in FIG. 3, when a compressor 11 is out of order, the whole of the refrigerating cycle related to the compressor becomes out of serice. No backup means is available for any of the refrigerating cycle, either.

OBJECTS OF THE INVENTION

It is therefore one of the objects of the first present invention to provide such a refrigeration system that a power required for the refrigeration system may be reduced by raising evaporating temperatures in evaporators as high as possible and/or by optimizing load sharing, and to provide such a refrigeration system that its reliability for operation is much improved by providing all compressors with a backup system.

Considering the embodiment shown in FIG. 6 of the present invention, there are supposed to exist refrigerating cycles operated at different condensing temperatures each other in some cases, e.g. when one of the condensers in the system is operated for both purposes of condensing refrgerant and for producing hot water from cooling water by heat-exchanging with the refrigerant. In this case, refrigerant may be caused to shift from one refrigerating cycle to another, because the differences exist in condensing pressures of refrigerant in their condensers.

To solve this problem, one common reservoir 13*a* may be equipped with the system as shown by an imaginary line in FIG. 6. In this case, however, advantages of the refrigeration base unit thanks to the formation of the aforementioned separate evaporating temperature lines 21, 22, 23 may possibly be lost, because the condensing pressure has to be set at the highest among those of the condensers.

It is therefore one of the objects of the second present inventions to provide such a refrigeration system having a plurality of refrigerating cycles that the refrigeration base unit is much improved by further improving the first invention.

Hereunder described are refrigeration facilities used for chilling a liquid with a refrigeration system having a plurality of refrigerating cycles. For details, referrence is made to one of the conventional liquid chilling facilities of this kind shown in FIG. 10, which shows chilling facilities for making malt cooling water. The malt cooling water of about 3 deg. C. is used for chilling malt juice down to 6 deg. C. in a counterflow type plate heat exchanger, before the malt juice is sent to a fermenting process after it is boiled up to nearly 100 deg. C. in a preparation process of brewing.

The facilities for chilling malt cooling water has, as shown in FIG. 10, a refrigerating cycle comprised of a compressor 11, a condenser 12, a reservoir 13, an expansion valve 14 and an evaporator 15, so that brine can be chilled in the evaporator 15.

The brine is circulated in a brine circulating line 79 from a brine tank 77 through the evaporator 15 by a pump 78. The cold brine is circulated in a brine circulating line 81 from the brine tank 77 through a heat exchanger 83 by a pump 80. To chill the raw water, heat exchange is conducted in a heat exchanger 83 between the brine circulated in the circulating line 81 and raw water flowing in raw water line 82.

As shown in FIG. 10, the facilities for chilling malt cooling water may work as a heat pump to recover heat from hot water, which has been heated by heat-exchange with refrigerant vapor in the condenser 12 of the refrigerating cycle 76. Altenatively, it may work as a mere refrigeration system, namely the hot water heated in the condenser 12 of the refrigerating cycle 76 may be cooled in a cooling tower and recycled to the condenser 12.

In a refrigeration facilities of hot water recovering type as shown in FIG. 10, cooling water will be heated in the condenser 12 of the refrigerating cycle 76, for example, from 25 deg. C. to 50 deg. C. at a condensing temperature T=52 deg. C., and the brine will be cooled down to −3 deg. C. at an evaporating temperature of −10 deg. C. in the evaporator 15. The raw water will be chilled from 25 deg. C. down to 3 deg. C.

And in refrigeration facilities of hot water non-recovering type where cooling water is cooled in a cooling tower, cooling water will be heated in the condenser 12 of the refrigerating cycle 76, for example, from 32 deg. C. to 37 deg. C. at a condensing temperature Tc=40 deg. C., and the brine will be chilled down to −3 deg. C. at an evaporating temperature of −10 deg. C. in the evaporator 15. The raw water will be chilled from 25 deg do. C. down to 3 deg. C.

In conventional facilities as described above, the common brine source is used not only for chilling raw water, but also used for covering the chilling loads in the other brewing processes such as maturing process, thus an evaporating temperature in the evaporator 15 of the refrigerating cycle 76 is set approximately as low as −8 to −10 deg. C.

As far as a refrigeration system is provided with only one single-stage refrigerating cycle, large shaft power and large displacement of the compressor are required and refrigeration efficiency is low, resulting in that saving energy in the system is not achievable.

It is therefore one of the objects of the present inventions to provide such a liquid chilling facilities that the refrigeration base unit is improved and energy saving is achieved by using a plurality of refrigerating cycles arranged in order of temperature from high to low in terms of different evaporating temperatures, and by making evaporating temperatures as high as possible in individual cycles, respectively.

SUMMARY OF THE INVENTION

To attain the above-described object, the present invention firstly provides a refrigeration system comprising a plurality of refrigerating cycles, each of which is comprised of a compressor and a plurality of suction lines connected to the compressor. The refrigerating cycle also comprises a condenser for condensing refrigerant discharged from the compressor, a reservoir for holding refrigerant coming from the condenser, a plurality of evaporators for evaporating refrigerant and a plurality of expansion means for throttling and expanding refrigerant before the evaporator. The reservoir is disposed between the condenser and the expansion means.

The system also comprises a plurality of connecting lines between the reservoir and the expansion means, and a plurality of separate main lines for individual evaporating temperatures. Each of the evaporators is connected with one of the separate main lines of temperature corresponding to its evaporating temperature. And each of the separate main lines is connected with one of the suction lines depending on evaporating temperature. And a suction valves is disposed in each of the suction lines, respectively.

According to the present invention, each compressor can suck refrigerant at the highest possible evaporating temperature or at the highest possible evaporating pressure from the most appropriate separate main line by choosing a valve disposed in the suction line to shut, open or throttle. And, every compressor can be assigned to the refrigeration load of the most appropriate evaporating temperature for itself. Furthermore, when a compressor is out of order, it can be backed up by the other compressors.

Every compressor is able to work at nearly full load and the optimization for load sharing is attainable, and each compressor is allowed to suck refrigerant at the most appropriate and highest possible evaporating temperature. Power consumption can be saved, since the desired evaporating temperature for a compressor can be chosen among a plurality of separate main lines of individual evaporating temperatures by means of valves at the suction lines. Additionally, reliability of the system for operation is much improved, since the compressors can be backed up each other.

The present invention secondly provides a refrigeration system comprising a plurality of refrigerating cycles, each of which comprises a compressor, a plurality of condensers, reservoirs, evaporators, expansion means for throttling and expanding refrigerant before the evaporator, and a means for transferring liquid refrigerant from any one of the reservoirs to every other reservoir.

According to the present invention, when refrigerant is sent from the reservoir to the expansion means such as expansion valves, refrigerant flow route is determined to form by choosing a valve to shut or open among refrigerating cycles of different condensing pressures. And, refrigerant is shifted from excess side to insufficiency side among refrigerating cycles of different condensing pressures.

The present invention allows each refrigerating cycle to have a specific condensing pressure by choosing a valve to shut or open as described above, and enables it to set a different condensing temperature. Further, it can reduce the refrigeration base unit in a refrigeration system having a plurality of refrigerating cycles which use a common refrigerant source, since a communicating line is provided between the reservoirs and expansion means, and is furnished with a valve to selectively shut or open. And, it is also feasible to make hot water in a certain condenser by setting high the condensing temperature in the condenser of the refrigerating cycle.

In the aforementioned invention, preferably, the means for transferring liquid refrigerant is comprised of a communicating line, a refrigerant pump disposed between the communicating line and the reservoir, and a return valve disposed between the communicating line and the reservoir.

Here the same effect as described above is obtained, since each refrigerating cycle can have a specific and appropriate different condensing pressure by choosing a pump to be operated and a valve to be open, and by distributing pressurized refrigerant properly through the communicating line among the reservoirs.

The present invention also provides a refrigeration system comprising a plurality of refrigerating cycles, each of which has a compressor, a condenser, a reservoir, an expansion means and an evaporator. The system also includes a plurality of connecting lines formed between the reservoirs and the expansion means, and furnished with a valve for selecting one of the connecting lines. Any one of the reservoirs is connected to every expansion means by a connecting line.

According to the present invention, refrigerant can be shifted from a certain refrigerat cycle of excess refrigerant to another of insufficient refrigerant. And a common refrigerant source can be used in multiple refrigerating cycles of different condensing pressures.

The present invention thirdly provides a refrigeration facilities comprising a plurality of refrigerating cycles, each of which has a compressor, a condenser, a reservoir, an expansion means and an evaporator, and a path through which liquid flows to be chilled by the evaporated refrigerant. The evaporators of the refrigerating cycles are arranged in order of the evaporating temperature in series from high to low according to the thermal gradient established along the path from upstream to downstream of the liquid. While the liquid is flowing through the path, the liquid exchanges heat with the refrigerant flowing through the evaporators of the refrigerating cycles.

According to the present invention, each evaporating temperature of refrigerant for chilling liquid can be kept at level as high as possible, since the evaporating temperatures are lined up according to the temperature gradient from high to low, and the liquid flows in one path along which the multiple evaporators are arranged in order of the evaporating temperature from high to low. This allows the facilities to reduce the refrigeration base unit and to save energy, as well as to reduce the required capacities of the refrigerating cycles so that the facilities can be made compact.

The present invention also provides refrigeration facilities further comprising a path for circulating brine including a heat exchanger between the evaporators and the path for the liquid to be chilled. That is, the facilities have the path for circulating brine in addition to a plurality of refrigerating cycles, each of which has a compressor, a condenser, a reservoir, an expansion means and an evaporator, and a path through which liquid to be chilled flows. The evaporators are arranged in order of the evaporating temperature in series from high to low according to the thermal gradient established along the brine path of from upstream to downstream. The brine is chilled in the evaporators of the multiple refrigerating cycles. The exchanger is placed in the both path of the brine circulating path, and of the path for the liquid to be chilled. While the liquid is flowing through the path, the liquid exchanges heat with the brine in the heat exchanger. That is, the refrigerant and the liquid will exchange heat indirectly through the brine.

According to the present invention, each evaporating temperature at which the brine is chilled can be kept at level as high as possible. Additionally, refrigerant will never leak to be mixed in the liquid to be chilled, since refrigerant exchanges heat with the liquid indirectly through the brine.

BRIEF DESCRIPTION OF THE DRAWINGS

These and other objects, features and advantages of the present invention will be more fully appreciated with reference to the accompanying figures.

DETAILED DESCRIPTION OF THE PREFERRED EMBODIMENT

Figure 1:
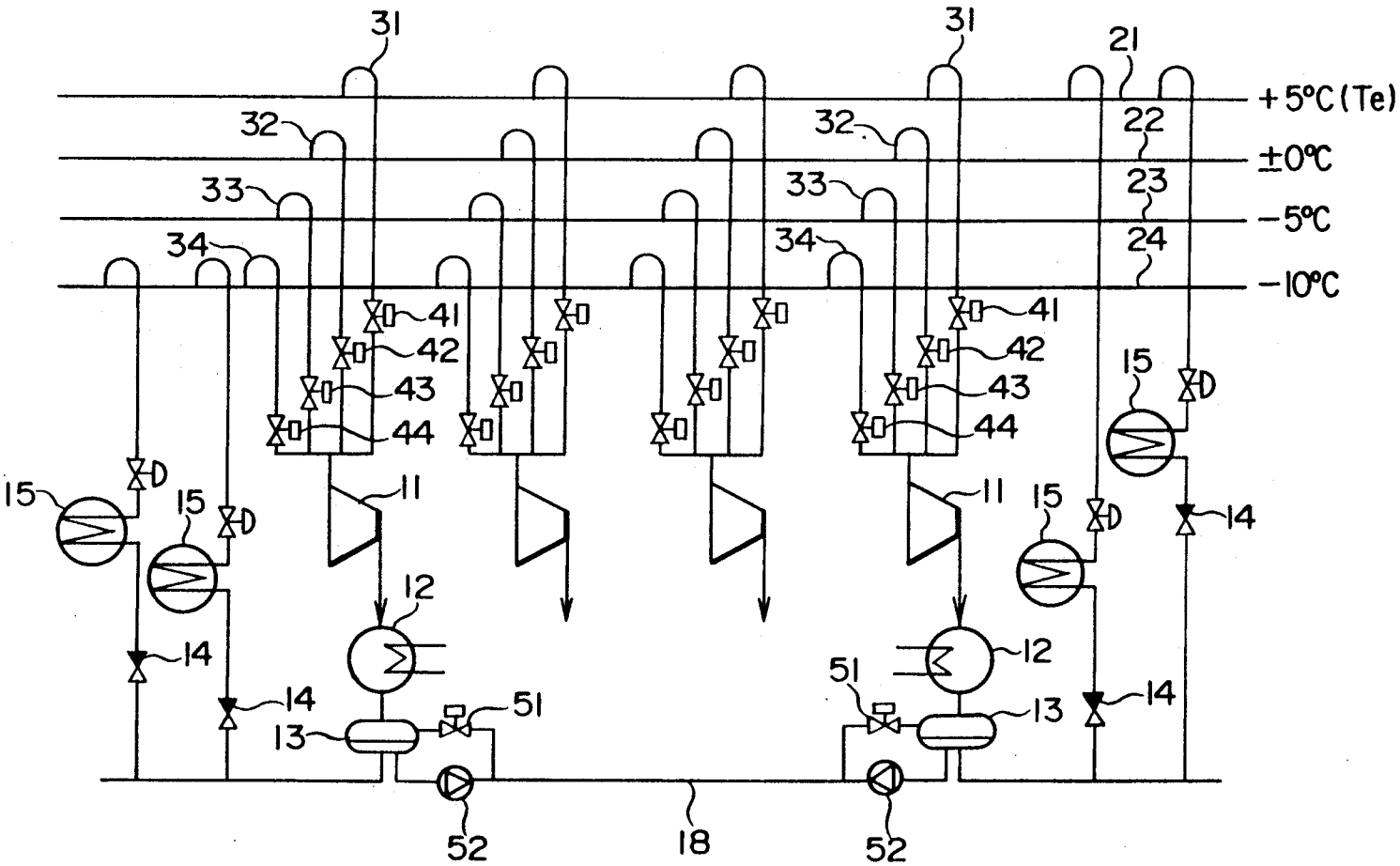
FIG. 1 is a flow diagram of an embodiment of the first invention.
Figure 2:
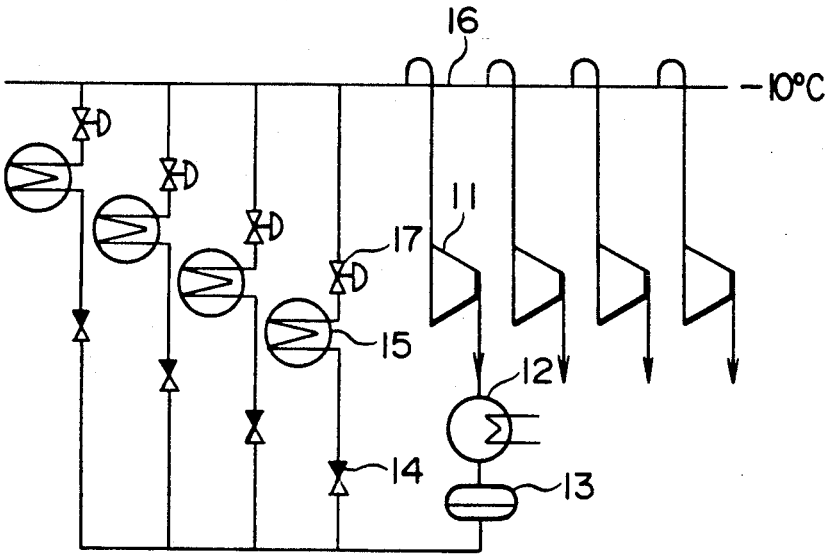
FIG. 2 is a flow diagram of a conventional refrigeration system according to a prior art.
Figure 3:
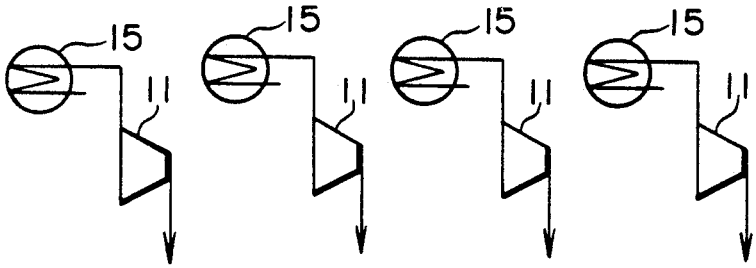
FIG. 3 is a flow diagram of another conventional refrigeration system according to a prior art.

Reference is first made to FIG. 1, wherein an embodiment of the first present invention is shown. Each of a plurality of refrigerating cycles is comprised of a compressor 11, a condenser 12, a reservoir 13, an expansion valve 14 and an evaporator 15. In this system, there are 4 separate main lines 21, 22, 23, 24 to provided for refrigerant vapor streams of different evaporating temperatures, e.g. 5, 0, −5 and −10 deg. C., respectively.

Figure 11:
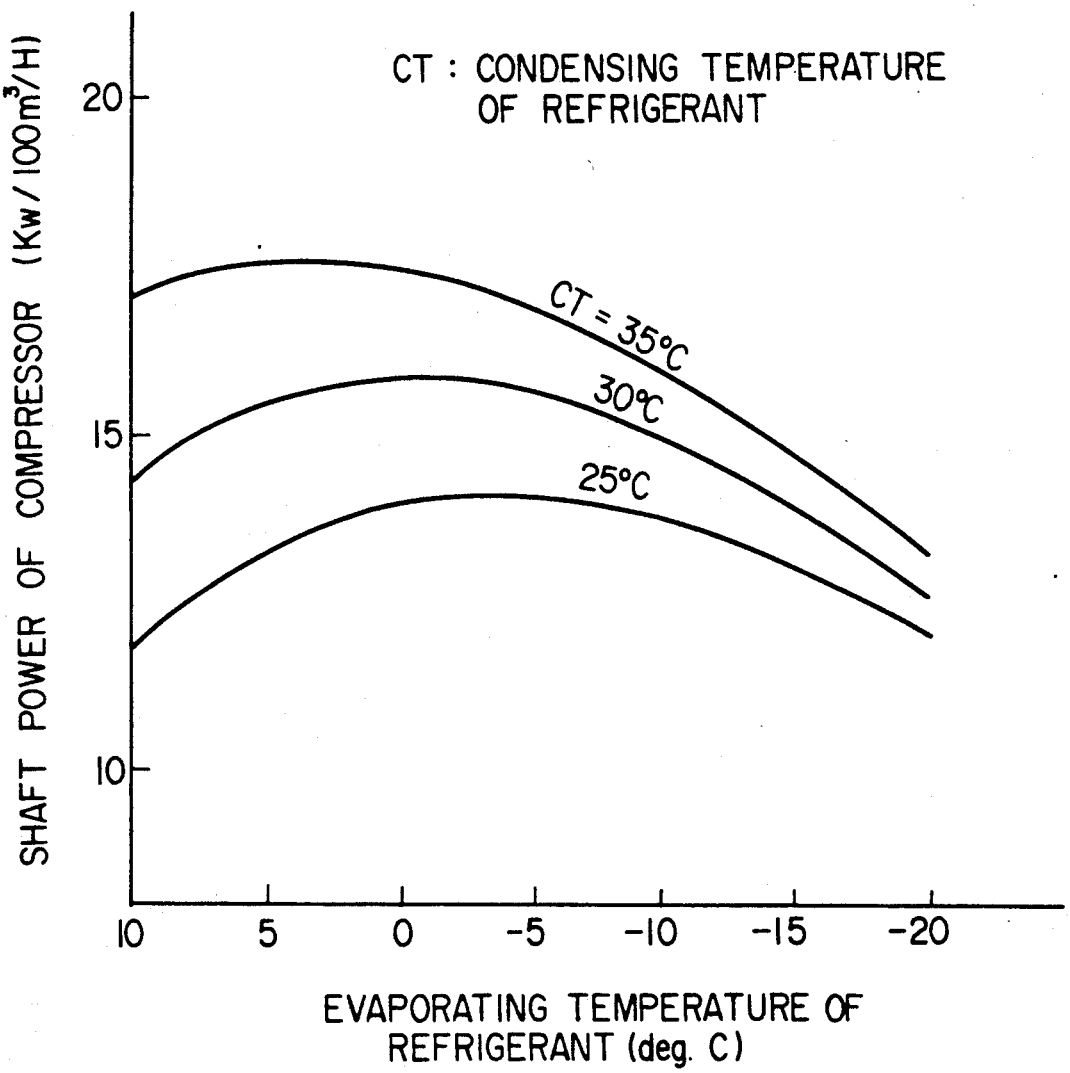
FIG. 11 is the graph of the correlation between the evaporating temperature (deg. C.) of refrigerant in the horizontal axis and the shaft power (KW/100 $m^3$/H) of a compressor in the horizontal axis.

By the way, these temperatures, 5, 0, −5 and −10 deg. C. have been selected for the following reasons:

For the first reason, referrence is made to FIG. 11, which shows the graph of the correlation between the evaporating temperature (deg. C.) of refrigerant in the horizontal axis and the shaft power (KW/100 $m^3$/H) of a compressor in the vertical axis as per the parameter of the condensing temperatures of refrigerant (35 deg. C., 30 deg. C., & 25 deg. C.).

The correlation has been prepared in accordance with the following equation;

$$Kw=(Vth/100)[Kwth/(\eta i/\eta v)+Kwo]$$

$$Kwth=17.85\cdot Ps[(Pd/Ps)^{0.1525}-1]$$

$$\eta i/\eta v = 0.742 + [0.074 - 0.0012(Tc - 30)](Pd/Ps) + 0.0054\ Tc - 30)$$

$$Kwo = 1.55$$

where,

KW: shaft power of a compressor per 100 $m^3/H$ (BKw)

Vth: theoretical displacement ($m^3/H$)

Kwth: theoretical shaft power of a compressor (BKw)

Ps: suction pressure (ata)

Pd: discharge pressure (ata)

Tc: condensing temperature (deg. C.)

Te: evaporating temperature (deg. C.)

$\eta i/\eta v$: ratio of indication efficiency to volume efficiency of compressor Kwo: friction power per 100 $m^3/H$ (BKw)

As shown in the FIG. 11, the correlation curves are substantially flat in the evaporating temperature range from −10 deg. C. to 5 deg. C. This means that as far as the refrigerating cycle is operated in this range, the shaft power of the compressor per 100 $m^3/H$ is not much fluctuated, in other words a desired temperature can be selected from the range without changing the shaft power of the driving unit for the compressor, thus without changing the driving unit itself such as an electric motor. This is the first reason for selecting 5, 0, −5 and −10 deg. C. as the evaporating temperature.

The second reasons is that brine or cold water of 5, 0, −5 and −10 deg. C. are actually used in breweries, and these 5, 0, −5 deg. C. brines are produced from the brine once chilled to −10 deg. C. Considering the above reasons, the above temperatures have been selected to compare the system according to the present invention with the conventional system.

Separate main lines 21, 22, 23, 24 are connected with each of the compressors 11 by suction lines 31, 32, 33, 34 disposed from the lines 21, 22, 23, 24 to each compressor. The suction lines 31, 32, 33, 34 of each compressor 11 are furnished with suction valves or automatic valves 41, 42, 43, 44 respectively, used to shut or open, and/or throttle the suction lines. The valve 41, 42, 43, 44 may be manual ones. The expansion valve 14 may be replaced with the other expansion means like a capillary tube.

Each compressor 11 can suck refrigerant at the highest possible evaporating temperature from the most appropriate line to itself out of lines 21, 22, 23, 24, by selecting to open or shut the valves 41, 42, 43, 44 furnished with each suction lines 31, 32, 33, 34, or by throttling them to control.

Consequently, the power consumption can be reduced as described hereinafter. And, by choosing the valve(s) to open or shut among the valves 41, 42, 43, 44, each compressor can be assigned to the load of the most appropriate line among the lines 21, 22, 23, 24 of different evaporating temperatures. Thus, the optimization for load sharing is attainable. Furthermore, any of compressors can be backed up each other, when it is out of order.

There is demonstrated an example of the effects of the present invention. The refrigeration base units are as indicated in Table 1, for evaporating temperatures 5, 0, −5 and −10 deg. C. while the condensing temperature Tc is 40 deg. C. common for the all refrigerating cycles.

TABLE 1

| Tc (deg. C.) | Te (deg. C.) | Base Unit (kWh/JRT) |
|---|---|---|
| 40 | 5 | 0.629 |
| 40 | 0 | 0.900 |
| 40 | −5 | 1.09 |
| 40 | −10 | 1.32 |

where JRT is Japanese Refrigeration Tonnage (approximately 3320 kcal/h).

On the other hand, if all of the compressors 11 suck refrigerant at −10 deg. C., all of the loads have to be burdened at refrigeration base unit of −10 deg. C., namely 1.32 kWh/JRT. In the present invention, each compressor 11 is allowed to suck refrigerant at the highest possible evaporating temperature for each, resulting in the effect that the refrigeration base unit can be reduced by the difference. And further a back-up system for the compressors becomes available by providing the automatic valves 41 to 44.

By the way, a condensing pressure of the refrigerant depends on its condensing temperature in a refrigerating cycle. Thus, when condensing pressures of the refrigerating cycles are different each other in the above mentioned systems, thus a plurality of refrigerating cycles of different condensing temperatures exist together, refrigerant may shift among the refrigerating cycles.

To compensate the above shift of refrigerant, an additional system as shown in FIG. 1 is proposed where a return valve 51 and a pump 52 are provided for each of reservoirs 13 to enable liquid refrigerant to be fed through a line 18 from any reservoir 13 to any evaporator 15 any time. In this manner, it is possible to distribute liquid refrigerant properly among reservoirs 13, while maintaining a different condensing pressure in each refrigerating cycle.

The refrigeration base unit can be further reduced as described above, if each cycle can have its own condensing temperature, keeping its own condensing pressure.

A reservoir 13 is for holding liquid refrigerant condensed in a condenser 12. And it may be independent from the condenser but also be incorporated with the condenser, e.g. the bottom portion of the condenser.

Furthermore, when the compressors 11 are various in size (refrigeration capacity), better effects for the proper distribution of the loads can be attained.

Figure 4:
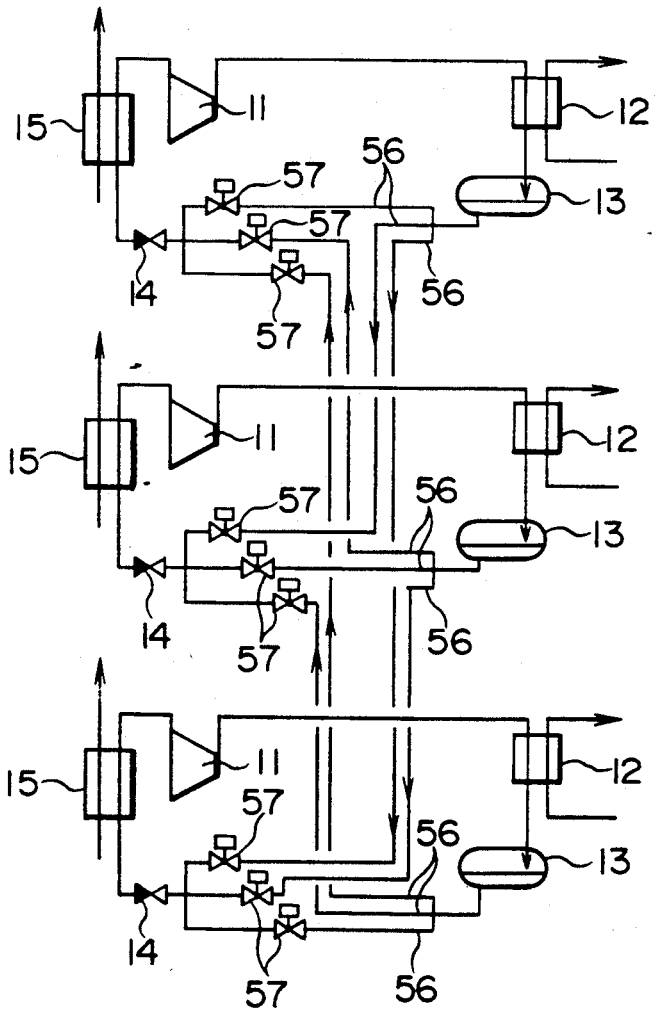
FIG. 4 is a flow diagram of an embodiment of the second invention.
Figure 5:
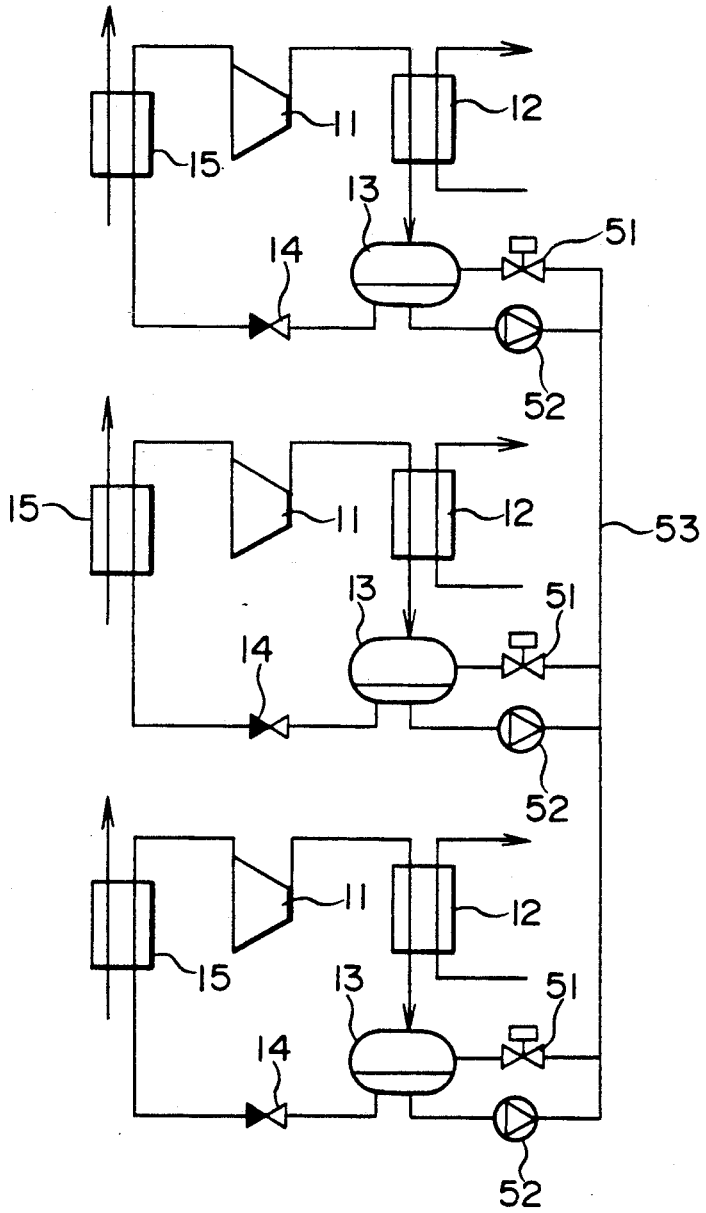
FIG. 5 is a flow diagram of another embodiment of the second invention.

The second present invention is described hereunder in detail referring to the embodiments in FIG. 4 and FIG. 5.

The embodiment in FIG. 4 is of a refrigerant feed system of multiple condensing pressures. In the system, each of a plurality of refrigerating cycles is comprised of a compressor 11, a condenser 12, a reservoir 13, an expansion valve 14 and an evaporator 15, respectively. Each of the refrigerating cycles uses the same refrigerant source in common, whereas the condensing pressures (namely condensing temperatures, too) are different each other. And the evaporating temperature of each cycle is set at a different level, individually.

All of the reservoirs 13 and all of the expansion valves 14 are communicated with each other by nine pipes 56 in the refrigerating cycles of FIG. 4 so that any reservoir and any expansion valve can communicate each other. The nine pipes are furnished with an automatic valve 57 respectively, which is selectively opened or shut.

When refrigerant is sent from a reservoir 13 to an expansion valve 14 in FIG. 4, the valves 57 are selectively opened or shut as necessary so that an appropriate refrigerant path is determined to form among refrigerating cycles of different condensing pressures. Thus, high pressure refrigerant can be fed from any reservoir 13 of a different condensing pressure to any evaporator 15. It will rectify uneven distribution of refrigerant which is caused by switching over the valves 41, 42, 43 corresponding to the lines 21, 22, 23 of different evaporating temperatures (refer to FIG. 6). Refrigerant can be shifted from an excess side to an insufficiency side among refrigerating cycles of different condensing pressures.

The embodiment in FIG. 5 is another example of a refrigerant feed system of multiple condensing pressures. In the system, each of a plurality of refrigerating cycles is comprised of a compressor 11, a condenser 12, a reservoir 13, an expansion valve 14 and an evaporator 15, respectively and has a different condensing pressure from the other. And additionally, an interconnecting pipe 53 is disposed among the reservoirs 13, a pump 52 is disposed in the branch pipe from the bottom of the reservoir 13 to pump up refrigerant from the reservoir 13 to the interconnecting pipe 53, and an automatic valve 51 is disposed in the line provided in parallel with the pump 52 in each cycle. The automatic valve 51 is used to choose the reservoir 13, to which refrigerant need be fed through the interconnecting pipe 53.

The pump 52 is operated to pump up refrigerant from the reservoir associated with the pump 52, and the valve 51 before the reservoir fed with refrigerant is opened so that refrigerant is re-distributed among the reservoirs 13 in the refrigerating cycles of different condensing pressures as shown FIG. 5 at higher pressure than that of the reservoir to be fed. In this system, high pressure refrigerant can be fed from any of condensers 12 to any evaporator any time among refrigerating cycles of different condensing pressures. This can compensate refrigerant shift among refrigerating cycles, which is caused by switching over of valves 41, 42, 43 (refer to FIG. 6) furnished with the lines coming from lines 21, 22, 23 of different evaporating temperatures. Refrigerant is sent from an excess side to an insufficiency side among refrigerating cycles of different condensing pressures.

As described above, high pressure refrigerant can be re-distributed by the refrigerant feed system of multiple condensing pressures in FIG. 4 or by high pressure refrigerant distribution system in FIG. 5 and a plurality of refrigerating cycles of different condensing pressures can be operated with a common refrigerant source. This improves further refrigeration base unit merit in power consumption of refrigeration system having several different evaporating temperatures (optimum load distribution system) as shown in FIG. 6.

Figure 6:
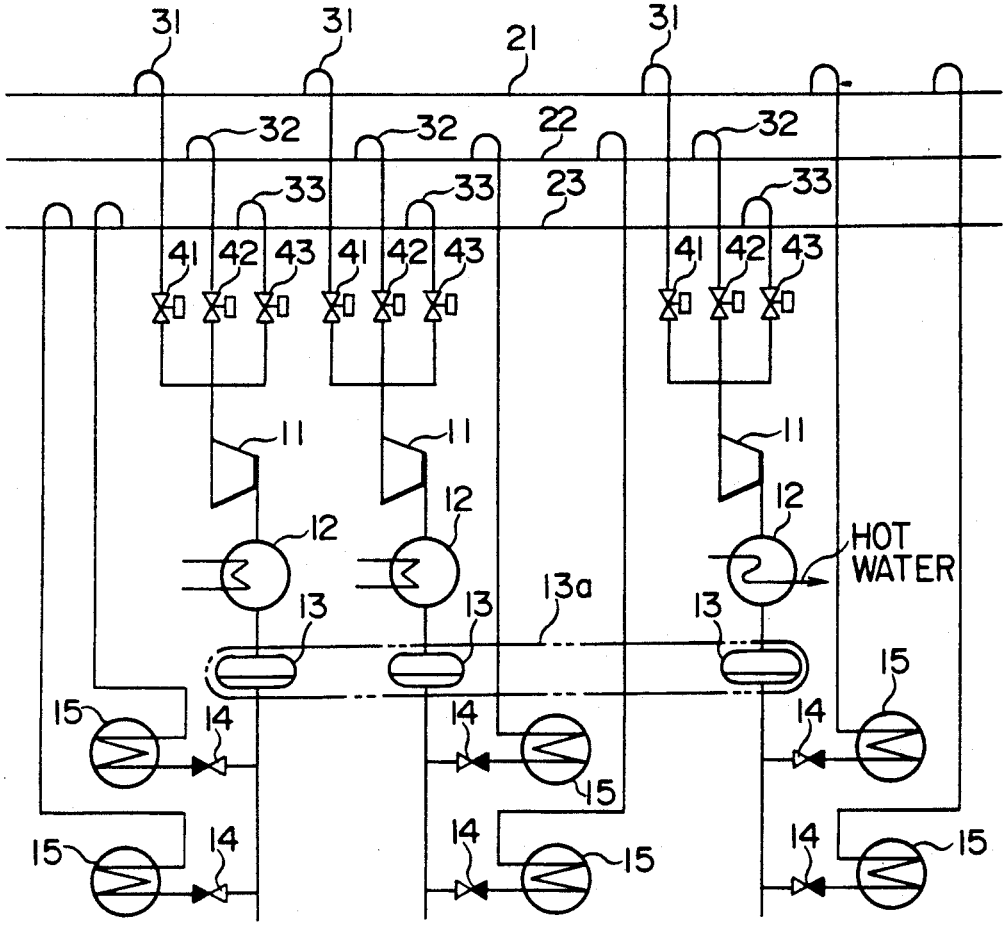
FIG. 6 is a flow diagram of a refrigeration system having separate lines through, each of which lines refrigerants of different temperatures flow, respectively.

In Table 2, refrigeration base units are indicated to compare two cases, that is, one case is that a common reservoir 13*a* is used for a plurality of refrigerating cycles as shown by an imaginary line in FIG. 6, making the condensing pressures equal at the highest and the other case is that liquid refrigeration is re-distributed according to the present invention. The refrigeration base units are calculated as shown in the table 2 in accordance to combinations of condensing temperature Tc and evaporating temperature Te.

TABLE 2

| | Common Reservoir Case | | | Re - distribution Dase | | |
|---|---|---|---|---|---|---|
| | Tc | Te | Ref. base unit | Tc | Te | Ref. base unit |
| Cycle 1 | 52 | 15 | 0.76 | 52 | 15 | 0.76 |
| Cycle 2 | 52 | 8 | 1.03 | 43 | 8 | 0.84 |
| Cycle 3 | 52 | 1 | 1.25 | 35 | 1 | 0.84 |
| Cycle 4 | 52 | −10 | 1.78 | 40 | −10 | 1.32 |

where Tc and Te are expressed as deg. C., and Ref. base unit is expressed as kWh/JRT.

From this table, obviously refrigeration base units can be outstandingly reduced in a liquid refrigerant re-distribution system according to the present invention, since evaporating temperatures Te are set at various values and also condensing temperatures Tc can be set individually at different values depending on the refrigerating cycles.

Figure 7:
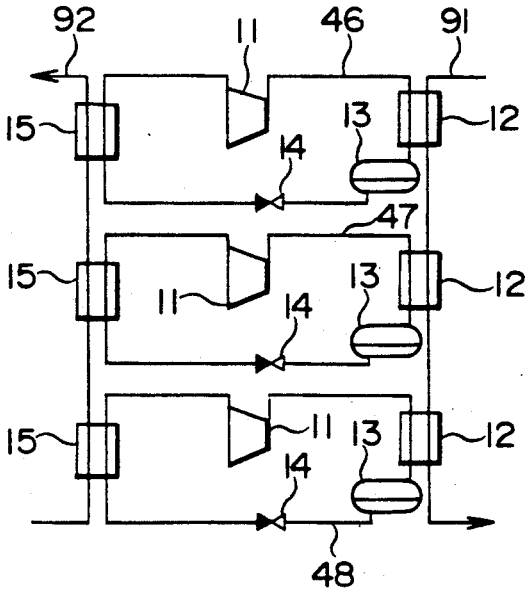
FIG. 7 is a flow diagram showing liquid chilling facilities of an embodiment of the third invention.

FIG. 7 shows an embodiment according to the third present invention. In this embodiment, there are 3 refrigerating cycles 46, 47, 48 arranged in accordance with a thermal gradient, each of which refrigerating cycles is comprised of a compressor 11, a condenser 12, reservoir 13, an expansion valve 14 and an evaporator 15.

In the condensers 12, 12, 12 of the respective refrigerating cycles, refrigerant exchanges heat in a counter flow manner with cooling water flowing through a path 91 of a heat pump system. The evaporators 15, 15, 15 of the refrigerating cycles 46, 47, 48 are arranged in order from a high evaporating temperature to low one along the path 92 from the upstream to the downstream, through which malt cooling water, or a liquid to be chilled flows. And the condensers 12, 12, 12 of the refrigerating cycles 46, 47, 48 are arranged in order from a low condensing temperature to high one along path 91 for cooling water of a heat pump system from the upstream to the downstream.

This system works as follows. In the condensers 12, 12, 12 of the refrigerating cycles 46, 47, 48, refrigerant exchanges heat in a counter flow manner with cooling water flowing through a path 91 of a heat pump system. The cooling water is in turn heated in the condensers 12, 12, 12 and flows out from the condensers to a path 91 of a heat pump system. And in the evaporators 15, 15, 15 arranged in order from a high evaporating temperature to low one along the path 92, refrigerant exchanges heat in a counter flow manner with a liquid to be chilled flowing through a path 92. This arrangement enables the evaporating temperatures of the refrigerating cycles 47 and 48 to be as high as possible, resulting in reduction of refrigeration base unit as a whole and energy saving.

The required capacity of each refrigerating cycle can be reduced by raising the saturating pressure of refrigerant sucked to the compressor 11 in each of the refrigerating cycles 46, 47, 48.

Refrigerant in the condensers 12, 12, 12 of the refrigerating cycles exchanges heat with cooling water flowing through a path 91 at the condensing temperatures in gradually rising order.

The temperature characteristics of this embodiment are as follows.

Condensing temperatures Tc are 35, 41 and 52 deg. C. in the condensers 12, 12, 12 of the refrigerating cycles 46, 47, 48, respectively. A cooling water flowing the path 91 of the heat pump system is 25 deg. C. at the inlet, and is heat-exchanged in condensers 12, 12, 12 of refrigerating cycles 46, 47, 48 in this order to be heated up to 33, 41, 50 deg. C. at each outlet of the condensers. The evaporating temperatures Te are 15, 8, 1 deg. C. in the evaporators 28, 28, 28 of the refrigerating cycles 48, 47, 46, respectively and the liquid to be chilled is chilled down to 17, 10, 3 deg. C., respectively.

Figure 8:
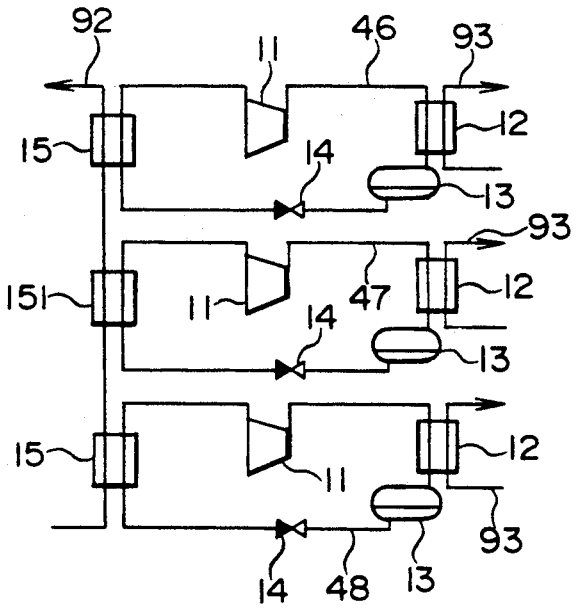
FIG. 8 is a flow diagram showing another scheme of liquid chilling facilities of an embodiment of the third invention.

FIG. 8 shows a construction of another embodiment according to the third present invention. In this embodiment, the refrigerating cycles are arranged in accordance with a thermal gradient. In the condensers 12, 12, 12 of the refrigerating cycles 46, 47, 48, refrigerant exchanges heat in a counterflow manner with cooling water flowing in paths 93, 93, 93 and then being recycled through a cooling tower.

The evaporators 15, 15, 15 of the refrigerating cycles 46, 47, 48 are arranged in order from a high evaporating temperature to low one along the path 92 from the upstream to the downstream, through which malt cooling water, or a liquid to be chilled flows.

This embodiment operates as follows. In the condensers 12, 12, 12 of the refrigerating cycles 46, 47, 48, refrigerant exchanges heat in a counterflow manner with cooling water recycled in paths 93, 93, 93 through a cooling tower.

And in the evaporators 15, 15, 15 of the refrigerating cycles arranged in order from a high evaporating temperature to low one along the path 92, refrigerant exchanges heat in a counter flow manner with a liquid to be chilled flowing through a path 92. This arrangement enables the evaporating temperatures of the refrigerating cycles 47 and 48 to be as high as possible, resulting in reduction of refrigeration base unit as a whole and energy saving.

The required capacity of each refrigerating cycle can be reduced by raising the saturating pressure of refrigerant sucked to the compressor 11 in each of the refrigerating cycles 47, 48.

The temperature characteristics of this embodiment are as follows.

Condensing temperatures Tc are 40 deg. C. in all the condensers 12, 12, 12 of the refrigerating cycles 46, 47, 48. A cooling water flowing the paths 93, 93, 93 is 25 deg. C. at all the inlets of the condensers, and is heat-exchanged in condensers 12, 12, 12 to be heated up to 37 deg. C. at all the outlet of the condensers. And, the evaporating temperatures Te are 15, 8, 1 deg. C. in the evaporators 28, 28, 28 of the refrigerating cycles 48, 47, 46, respectively, and the liquid of 25 deg. C. to be chilled is chilled down to 17, 10, 3 deg. C., respectively.

Figure 9:
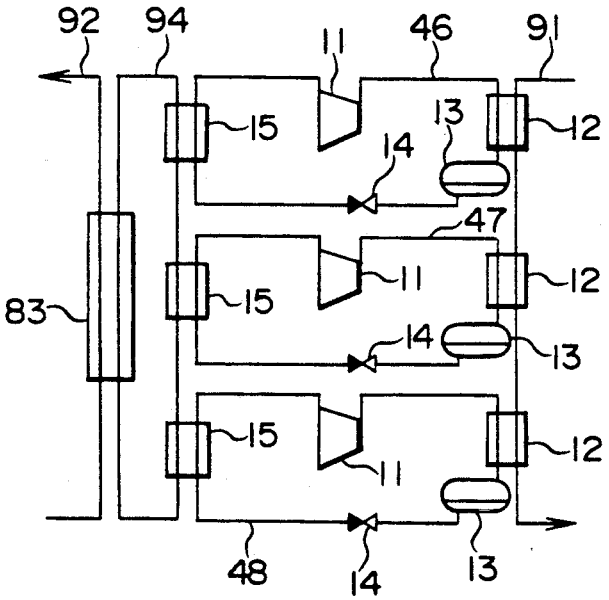
FIG. 9 is a flow diagram showing liquid chilling facilities of a modified embodiment of the third invention.

FIG. 9 shows another embodiment according to the third present invention. This embodiment is similar to that shown in FIG. 7. The evaporators 15, 15, 15 of the refrigerating cycles 46, 47, 48 are arranged in order from a high evaporating temperature to low one along the path 94 from the upstream to the downstream, through which brine is circulated. A heat exchanger 83 is furnished in the both of the path 94, through which brine chilled in the evaporators 15, 15, 15 is circulated in the refrigerating cycles 46, 47, 48, and of the path 92 for liquid to be chilled. The liquid to be chilled flows through the heat exchanger 83 and the path 92. The refrigerant flowing the evaporators 15, 15, 15 of the refrigerating cycles 46, 47, 48 exchanges heat with a liquid to be chilled flowing the path 92 through the brine.

This arrangement enables the evaporating temperatures of the refrigerating cycles to be as high as possible. The evaporated refrigerant chills brine, which in turn chills a liquid to be chilled flowing in the path 92. And refrigerant will never be mixed in the liquid to be chilled in the path 92, even when refrigerant of the refrigerating cycles 46, 47, 48 leaks out from the evaporators 15, 15, 15, since refrigerant and the liquid exchange heat each other through the brine. The brine is chilled down to 0 deg. C. and heated up to 22 deg. C. in the heat exchanger.

In the embodiment of FIG. 9, cooling tower water may be used as a cooling water just the same as the condenser arrangement of FIG. 8.

Figure 10:
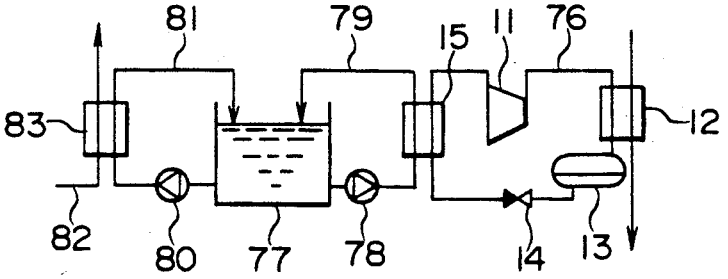
FIG. 10 is a flow diagram of conventional liquid chilling facilities.

The embodiments of the present invention shown in FIG. 7 and FIG. 8 are compared based on experiments to the prior art as shown in FIG. 10 in terms of running costs and compressor capacities, and the results are as shown in the following table 3 and 4. Those figures have been obtained for 300 JRT refrigerant system without heat-exchange through brine as a secondary refrigeration medium.

TABLE 3

| Facilities shown in FIG. 7 and FIG. 8 | | | | |
|---|---|---|---|---|
| Shaft Power (kW) | 82 | 79 | 80 | Total 241 |
| Displacement (cubic meter) | 874 | 1038 | 1277 | Total 3189 |
| Conditions (Tc/Te) (deg. C.) | 52/15 | 43/8 | 35/1 | |

TABLE 4

| Facilities shown in FIG. 10 | |
|---|---|
| Shaft Power (kW) | 449 |
| Displacement (cubic meter) | 4887 |
| Conditions (Tc/Te) (deg. C.) | 52/1 |

From the above result of the experiment, it is understood that the shaft power and displacement in the facilities in FIG. 7 and FIG. 8 are reduced to $\frac{1}{2}$ and to $\frac{1}{3}$, respectively, compared to those of the facilities in FIG. 10.

The aforementioned embodiments include three refrigerating cycles, but not be restricted to three, and the present inventions are applicable to any plural number of refrigerating cycles.

A liquid to be chilled is not restricted to malt cooling water but the present invention is applicable for chilling any kind of liquids.

Although a specific embodiment of the invention has been disclosed, it will be understood by those of skill in the art that the forgoing and other changes in form and details may be made therein without departing from the spirit and the scope of the invention.

What is claimed is:

1. A refrigeration system comprising;

a plurality of main lines provided respectively for each of refrigerant vapor streams of different temperatures, and a plurality of refrigerating cycles, each of the refrigerating cycles having;

a compressor connected with suction lines, each of which is equipped with a suction valve, and is connected to each of said main lines, individually, a condenser for condensing refrigerant discharged from the compressor, a reservoir for holding refrigerant coming from the condenser;

at least one evaporating unit consisting of a expansion means and a evaporator, where the expansion means throttles refrigerant coming from the reservoir and expands into the evaporator, and the evaporator evaporates the refrigerant at one of said different temperatures to send the refrigerant into the main line through which the refrigerant vapor stream flows at the same temperature as said one of the different temperatures.

2. A refrigeration system cited in claim 1, wherein said different temperatures of said refrigerant are selected from the temperature range from −10 deg. C. to +5 deg. C.

3. A refrigeration system cited in claim 1, wherein the suction valve is an automatic valve with an adjustable valve opening.

4. A refrigeration system cited in claim 1, wherein each of the refrigerating cycles comprises a condenser, a reservoir, an expansion means and an evaporator.

5. A refrigeration system cited in claim 4, wherein said means for transferring liquid refrigerant consists of a refrigerant transferring line from said reservoir to a reservoir in every other refrigerating cycle, and a valve provided for the refrigerant transferring line so that refrigerant may be transferred from said reservoir to a selected reservoir in other refrigerating cycles through the refrigerant transferring line with a selectively opened valve by the pressure difference between said reservoir and the selected reservoir, provided that the pressure of the refrigerant in said reservoir is higher than that of refrigerant in the selected reservoir.

6. A refrigeration system cited in claim 4, wherein the means for transferring liquid refrigerant consists of a pump connected with said reservoir, a refrigerant transferring line formed from the pump to a reservoir of every other refrigerating cycle, and a valve provided in the refrigerant transferring line so that refrigerant may be transferred by the pump from said reservoir to a selected reservoir of other refrigerating cycles through the refrigerant transferring line with the valve selectively opened.

7. A refrigeration system having a plurality of refrigerating cycles, each of the refrigerating cycles comprising:

a compressor, a condenser for condensing refrigerant discharged from the compressor, a reservoir for holding refrigerant coming from the condenser, at least one evaporating unit equipped with a expansion means and a evaporator, where the expansion means throttles refrigerant coming from the reservoir and expands into the evaporator, and the evaporator evaporates the refrigerant into a suction line of the compressor, and a means for transferring liquid refrigerant from said reservoir to a reservoir in every other refrigerating cycle.

* * * * *